US005681228A

United States Patent [19]

Mikame et al.

[11] Patent Number: 5,681,228

[45] Date of Patent: Oct. 28, 1997

[54] GOLF CLUB HEAD

[75] Inventors: Daisuke Mikame, Saitama-ken; Yasunori Imamoto, Tokyo; Hirato Shimasaki; Hiroshi Ezaki, both of Saitama-ken, all of Japan

[73] Assignee: Bridgestone Sports Co., Ltd., Tokyo, Japan

[21] Appl. No.: 558,450

[22] Filed: Nov. 16, 1995

[51] Int. Cl.[6] ..... A63B 53/04

[52] U.S. Cl. ..... 473/330; 473/349

[58] Field of Search ..... 273/167 J, 175, 273/167 F, 169, 167 R; 473/324, 329, 330, 334, 341, 343, 344, 345, 346, 349, 280, 291, 290, 292

[56] References Cited

U.S. PATENT DOCUMENTS

| | | | |
|---|---|---|---|
| 2,395,837 | 3/1946 | Baymiller | 273/175 |
| 3,743,297 | 7/1973 | Dennis | 273/175 |
| 4,367,878 | 1/1983 | Schmidt | 273/175 |
| 4,471,961 | 9/1984 | Masghati | 273/175 |
| 4,618,149 | 10/1986 | Maxel | 273/175 |
| 4,725,062 | 2/1988 | Kinney | 273/175 |
| 4,840,380 | 6/1989 | Kajita | 273/169 |
| 4,881,739 | 11/1989 | Garcia | 273/175 |

*Primary Examiner*—Sebastiano Passaniti

*Attorney, Agent, or Firm*—Jordan and Hamburg

[57] ABSTRACT

A golf club head has a gravity depth of 27 mm or greater and a convexed face with bulge and roll radii each equal to 9 inches or less. In an embodiment, a club head has a gravity depth of 27 mm, a bulge radius in the range of 6 to 8 inches and a roll radius of 7 to 9 inches. In another embodiment, a club head has a gravity depth of 30 to 35 mm, a bulge radius in the range of 6 to 8 inches and a roll radius of 7 to 9 inches.

4 Claims, 4 Drawing Sheets

GOLF CLUB HEAD

BACKGROUND OF THE INVENTION

1. Field of the Invention

The present invention relates to a golf club head in which the center of gravity is at a depth of 27 mm or more from the head face.

2. Description of the Prior Art

In general, a wood club head has a body 1 having a front face (club face) 2 at which a golf ball is struck as illustrated in FIG. 1. The golf club is designed to have a center of gravity G lying in the head thereof and on which a resultant of the forces acting on the club head concentrates to balance the forces. Also the center of weight distribution falls on the center of gravity G. The distance between the center of gravity G and face 2 is called "depth of center of gravity (will be referred to as "gravity depth" hereinafter)" $Z_G$. As shown in FIG. 2, the club face 2 has a horizontal curvature, more precisely, a bulge which is a part of a circle having a radius $R_1$ which is called "bulge radius". In general, the bulge radius $R_1$ of a persimmon wood club called "driver" is 10 inches. Also, the club face 2 has a vertical curvature, more precisely a roll which is a part of a circle having a radius of $R_2$ which is called "roll radius" as shown in FIG. 3. Generally, the roll radius $R_2$ of the persimmon "driver" head is 10 inches. Assume that a club head has a bulge shown in FIG. 2. When struck with the club head at a position nearer to the toe than to the face center, a ball B will be given a slice spin and thus be caused to fly more rightward (slicing) than when struck just at the face center. When struck at a position nearer to the heel of the club head than to the center, a ball B is given a hook spin. In this case, the ball B is caused to fly more leftward (hooking) than when struck just at the face center. Also assume that a club head has a roll shown in FIG. 5. If a ball B is struck with the club head at the upper face portion thereof, an over spin (less back spins) is imparted to the ball B which will thus be caused to fly higher that when struck just at the face center. If a ball B is struck at the lower face portion, a back spin is imparted to the ball B. In this case, the ball B is caused to fly lower than when struck just at the face center. The above is called "gear effect".

Most conventional head bodies 1 have a gravity depth of 20 to 25 mm. Few head bodies 1 made of stainless steel have a gravity depth exceeding 25 mm. Recently, club head bodies made of a metal low in specific gravity such as titanium, aluminum or other alloy have been proposed and already commercially available. Their gravity depth exceeds 25 mm, and some of them have a gravity depth of 30 mm or more. The greater the gravity depth, the larger the moment of inertia is. The greater gravity depth assures a greater flying directional stability of the ball struck with such club head. The moment of inertia will cause a moving object (club head) to continue the same movement even after externally acted upon (when striking a ball). The club face 2 has a sweet spot or area. When struck by the club head at a point within the sweet area of the club face 2, a ball can be carried over a distance equal to 95% or more of a maximum carry designed for the club head with a slice or hook by 5% or less of the maximum designed carry. The sweet area consists of such hitting points on the head face 2. For example, assume that a club head provides a maximum carry of 200 meters. The sweet area of this club head consists of such hitting points that when struck with the club head, a ball can be carried over a distance of 190 meters or more with a slice or hook of 10 meters. The sweet are has a close relation with the moment of inertia and gravity depth of the club head. Namely, the greater the moment of inertia, the larger the sweet area is. The deeper the position of center of gravity, the larger the sweet area is. The club heads recently proposed have a larger volume and deeper gravity. These features themselves lead to the enlargement of the sweet area.

The greater gravity depth of the recent golf club heads enhances the gear effect, which increases the back and side spins to the bail struck with the club. However, the conventional dub head faces cannot make the most of the gear effect because the bulge and roll thereof are not optimum for the gravity depth in the club heads.

SUMMARY OF THE PRESENT INVENTION

The present invention has an object to provide a golf club head in which optimum bulge and roll radii are designed for a deeper center of gravity to have a wider sweet area.

The above object can be accomplished by providing a club head in which the gravity depth is 27 mm or more, bulge radius is 9 inches or less and roll radius is 9 inches or less.

According to the present invention, since the gravity depth is 27 mm or more, and both the bulge and roll radii are 9 inches or less, the roundness of the club face matches the gravity depth so that the sweep area of the club head is increased as compared with the conventional club heads of which the bulge and roll radii are more than 9 inches. So, striking a ball by the club head according to the present invention, which would result in an unsuccessful shot when struck with any of the conventional club heads, will lead to a flight of the ball without so much loss of the flying distance and extreme hook or slice.

How the foregoing and other more specific objects of the present invention are achieved will appear in the ensuing more detailed description of illustrative embodiments of the invention which will now be set forth in reference to the drawings.

DETAILED DESCRIPTION OF THE PREFERRED EMBODIMENTS

Figure 1:
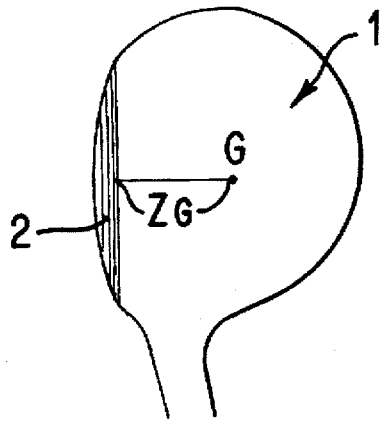
FIG. 1 is a plan view of a golf club head, showing the position of a center of gravity.

FIG. 1 is a plan view showing the position of a center of gravity G. The distance of this center of gravity G from the face of a club head is called "gravity depth" $Z_G$ as having previously been described. The gravity depth $Z_G$ of the club head according to the present invention is 27 mm or more.

Figure 2:
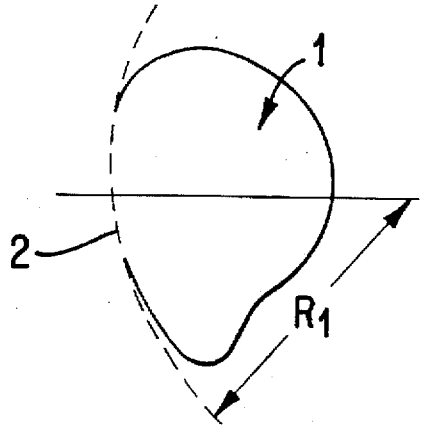
FIG. 2 is an explanatory drawing showing the bulge radius of the club face.
Figure 3:
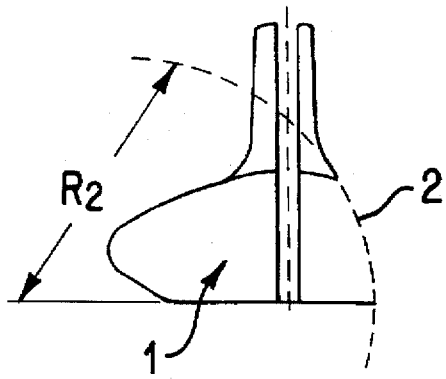
FIG. 3 is an explanatory drawing showing the roll radius of the club face.
Figure 4:
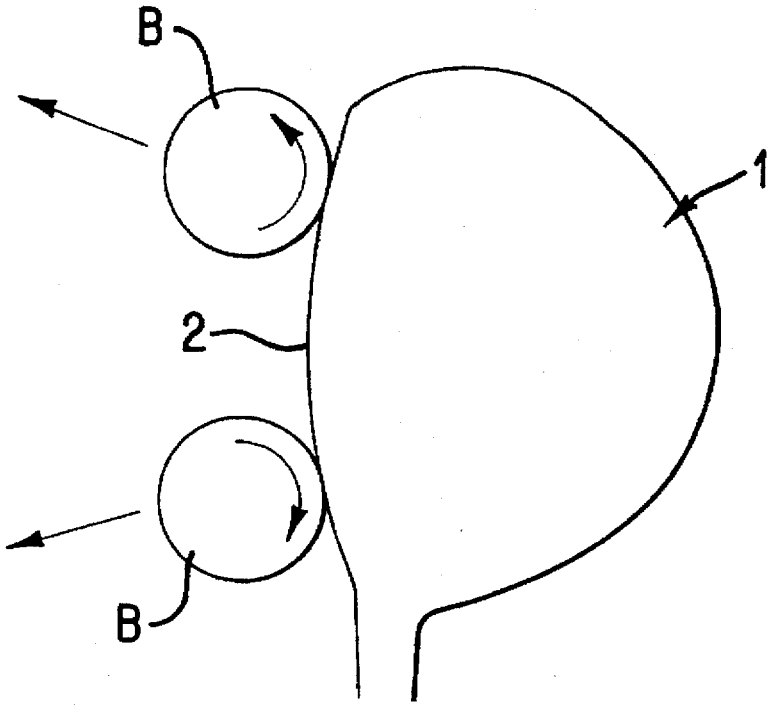
FIG. 4 is a drawing to explain the gear effect due to the bulge radius.
Figure 5:
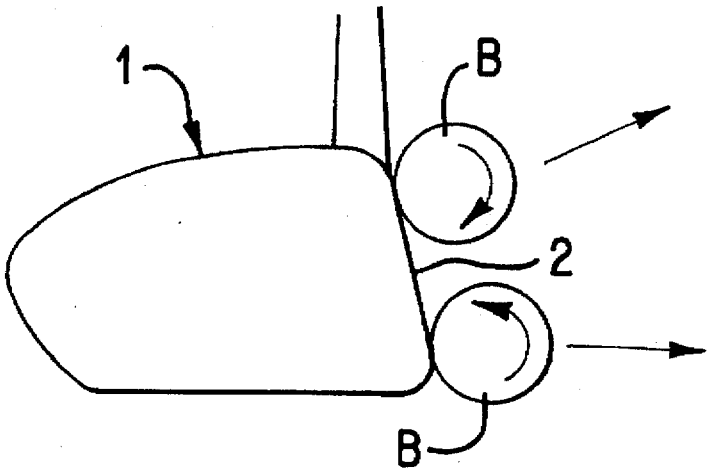
FIG. 5 is a drawing to explain the gear effect due to the roll radius.

The bulge radius $R_1$ of the club head shown in FIG. 2 is 9 inches or less, and the roll radii $R_2$ shown in FIG. 3 is also 9 inches or less. In case of a club head having a gravity depth $Z_G$ of 30 mm, the bulge radius of the club face is 6 to 8.5 inches, preferably 8 inches while the roll radius is 7 to 9 inches, preferably 8 inches. In case the gravity depth $Z_G$ is 35 mm, the bulge radius of the head face is 5.5 to 7 inches, preferably 6 inches while the roll radius is 6 to 8 inches, preferably 7 inches.

In the conventional club head of which the gravity depth $Z_G$ is 25 mm, bulge radius is 9 inches and roll radius is 10 inches, the sweet area is a maximum of 618 $mm^2$. In a golf club head according to a first embodiment of the present invention and of which the gravity depth $Z_G$ is 30 mm, bulge radius is 7 inches and roll radius is 8 inches, the sweet area is 651 $mm^2$. Also, in a club head according to a second embodiment of the present invention and of which the gravity depth $Z_G$ is 35 mm, bulge radius is 6 inches and roll radius is 7 inches, the sweet area is 672 $mm^2$. In a club head having a gravity depth of 35 mm and the same bulge and roll radii as those above in the conventional club head, the maximum sweet area is 566 $mm^2$. Also in a club head having a gravity depth $Z_G$ of 30 mm and the same bulge and roll radii as those above in the conventional club head, the maximum sweet area is 597 $mm^2$. As evident from the foregoing, the sweet area of the club head having the gravity depth $Z_G$ of 30 mm according to the present invention is a maximum of 9% larger than that of the conventional club head, and that of the club head having a gravity depth $Z_G$ of 35 mm according to the present invention is a maximum of 18.7% larger than that of the conventional club head.

Figure 6:
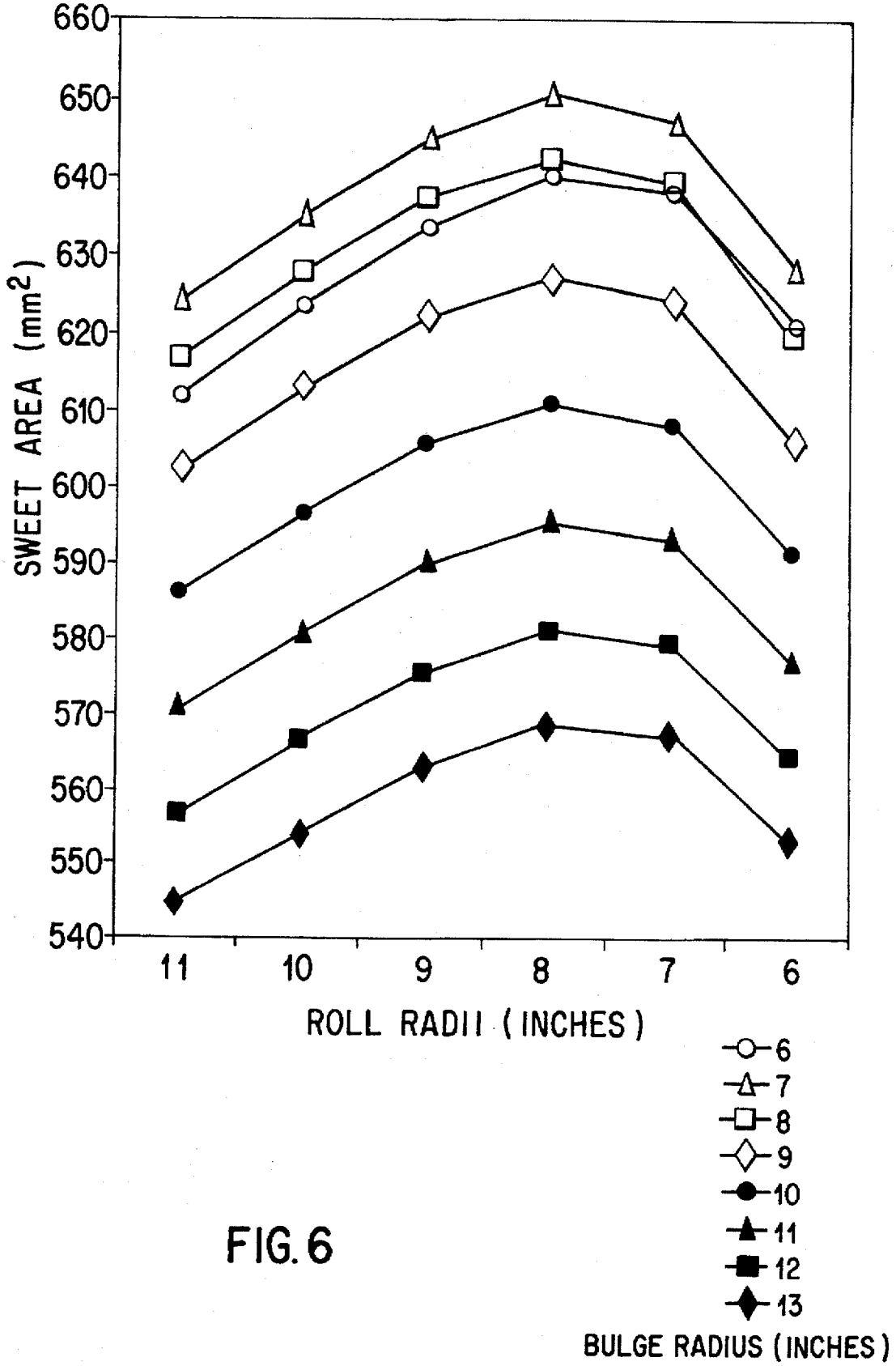
FIG. 6 graphically shows the change in sweet area size, incidental to changes in bulge and roll radii, of a club head in which the center of gravity is at a depth of 30 mm.

FIG. 6 is a graph showing the change in sweet area size, incidental to changes in bulge radius $R_1$ and roll radius $R_2$, of the club head having the gravity depth $Z_G$ of 30 mm. As seen from FIG. 6, when the bulge radius is 7 inches and roll radius is 8 inches, the club face has a maximum sweet area.

Figure 7:
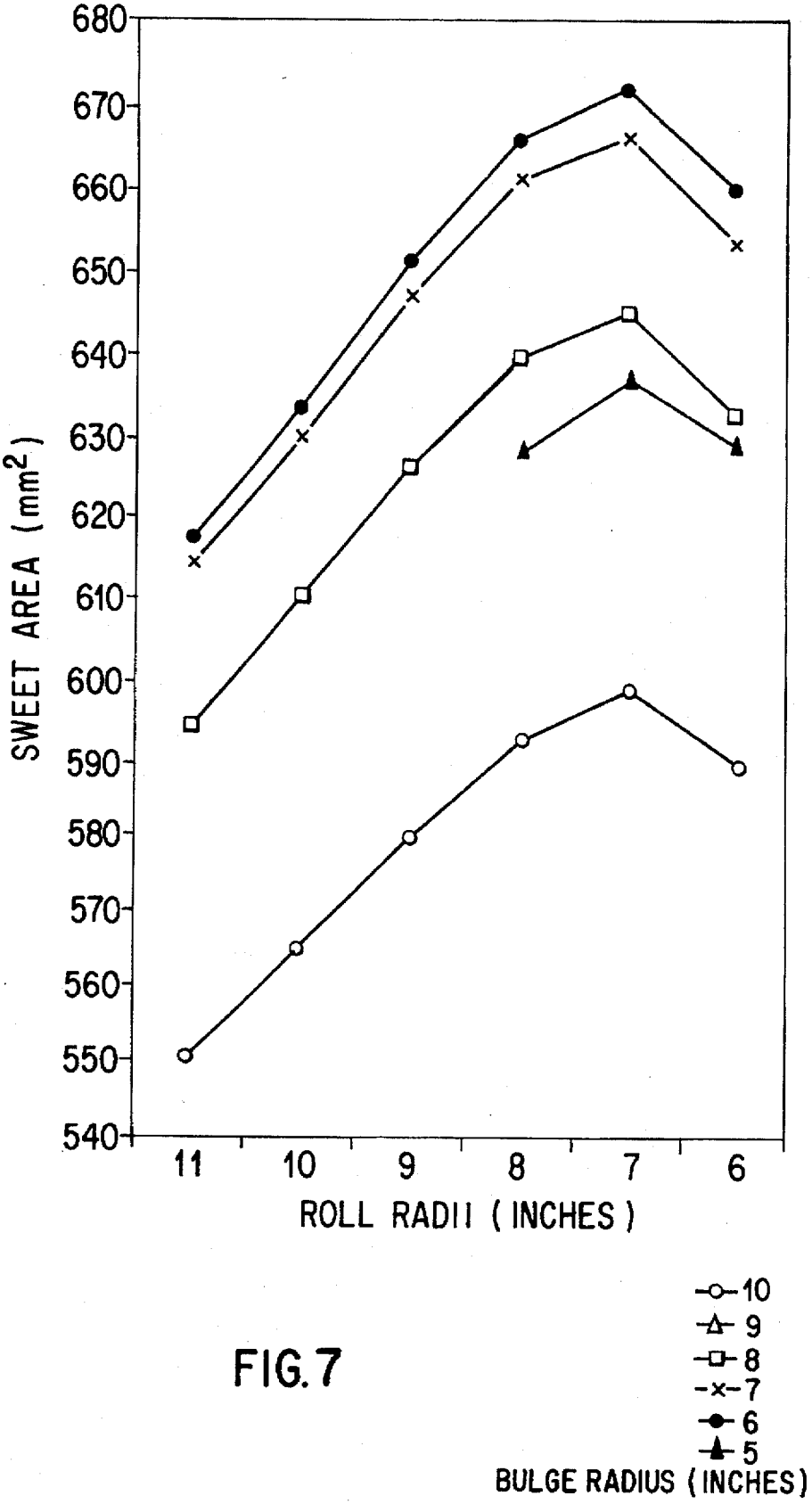
FIG. 7 graphically shows the change in sweet area size, incidental to changes in bulge and roll radii, of a dub head in which the gravity depth is 35 mm.

FIG. 7 graphically shows the change in sweet area size, incidental to changes in bulge radius $R_1$ and roll radius $R_2$, of the club head having the gravity depth $Z_G$ of 35 mm. As seen from FIG. 7, when the bulge radius is 6 inches and roll radius is 7 inches, the club face has a maximum sweet area.

In case the golf club head has a gravity depth $Z_G$ of 25 mm according to the present invention, the sweet area is a maximum of 618 $mm^2$ even when both the bulge and roll radii $R_1$ and $R_2$ are 9 inches or less. For a sweet area of 623 $mm^2$, both the bulge and roll radii $R_1$ and $R_2$ are 9 inches. When a club ead has a bulge radius $R_1$ of 9 inches and roll radius $R_2$ of 8 inches, the club face has a sweet area of 618 $mm^2$. In case the bulge radius $R_1$ is 10 inches and roll radius $R_2$ is 8 inches, the sweet area is 614 $mm^2$. When both the bulge and roll radii $R_1$ and $R_2$ are 7 inches, the sweet area is 599 $mm^2$.

The club head should preferably be made of a material appropriately selected from among stainless steel, aluminum or its alloy, titanium or its alloy, copper or its alloy and any other metal. It should be noted that the club head may be made of a fiber reinforced plastic. Also, it may be made of a combination of different materials. The club head body 1 is hollow and may be filled with a lightweight expansible material or with nothing.

As having been described in the foregoing, the present invention permits to provide a golf club head having a gravity depth of 27 mm or more and which has a larger sweet area for easy ball-striking through setting of an optimum bulge radius and roll radius.

What is claimed is:

1. A golf club head comprising:

a head body having a convexed front face defined by a bulge arc extending from toe to heel of the head body and a roll arc extending from top to sole of the club head;

said head body having a gravity depth defined by a shortest distance between a center of gravity of the head body and said convexed front face, and said gravity depth (Zg) being 27 mm or more;

said bulge arc having a radius (R1) of 6 to 8 inches in a horizontal plane; and said roll arc having a radius (R2) of 7 to 9 inches in the vertical plane.

2. A golf club head as set forth in claim 1 wherein said gravity depth (Zg) is 30 to 35 min.

3. A golf club head comprising:

a head body having a convexed front face defined by a bulge arc extending from toe to heel of the head body and a roll arc extending from top to sole of the club head;

said head body having a gravity depth defined by a shortest distance between a center of gravity of the head body and said convexed front face, and said gravity depth (Zg) of about 35 mm;

said bulge arc having a radius (R1) of about 6 inches in a horizontal plane; and said roll arc having a radius (R2) of about 7 inches in the vertical plane.

4. A golf club head comprising:

a head body having a convexed front face defined by a bulge arc extending from toe to heel of the head body and a roll arc extending from top to sole of the club head;

said head body having a gravity depth defined by a shortest distance between a center of gravity of the head body and said convexed front face, and said gravity depth (Zg) of about 30 mm;

said bulge arc having a radius (R1) of about 7 inches in a horizontal plane; and said roll arc having a radius (R2) of about 8 inches in the vertical plane.

* * * * *